United States Patent [19]

White

[11] Patent Number: 4,518,203

[45] Date of Patent: May 21, 1985

[54] CONVERTIBLE CUSHION FURNITURE

[76] Inventor: Kirk E. White, P.O. Box 204, Silver Springs, Nev. 89429

[21] Appl. No.: 557,489

[22] Filed: Dec. 2, 1983

[51] Int. Cl.[3] ..... A47C 1/02

[52] U.S. Cl. ..... 297/456; 5/465; 297/108; 297/109; 297/118; 297/380

[58] Field of Search ..... 297/456, 118, 108, 109, 297/380; 5/465

[56] References Cited

U.S. PATENT DOCUMENTS

| | | | |
|---|---|---|---|
| 1,393,619 | 10/1921 | Gardner | 5/465 |
| 2,623,574 | 12/1952 | Damsch | 297/118 X |
| 2,973,888 | 3/1961 | Beadsley | 297/380 |
| 3,469,882 | 9/1969 | Larsen | 297/118 |
| 3,902,759 | 9/1975 | Monteforte et al. | 297/456 |
| 4,040,881 | 8/1977 | Wallace | 297/456 |

*Primary Examiner*—James T. McCall

*Attorney, Agent, or Firm*—Harvey B. Jabobson

[57] ABSTRACT

Four substantially parallelopiped cushions are provided and disposed in end-to-end relation and positionable on a plane surface with either first or second corresponding face surfaces of the cushions opposing the plane surface. Each pair of adjacent cushion ends are connected together for relative angular displacement about a transverse axis extending along corresponding end transverse marginal portions of the first corresponding face surfaces of the cushions. Three adjacent cushions of the four cushions are of generally the same length while the fourth cushion is of a length equal to approximately one half the length of each of the other three cushions. The longitudinal edges of the first face surface of a first end cushion comprising the fourth cushion include first anchor flaps secured thereto for angular displacement relative thereto about axes extending along those longitudinal edges and the longitudinal edges of the second face surface of a second cushion immediately adjacent the other end cushion includes second anchor flaps extending therealong and secured thereto for angular displacement relative to the second cushion about axes extending along the last-mentioned longitudinal edges. The cushions, through utilization of adjustable length elongated tension members releasably connected between pairs of corresponding first and second flaps, may be arranged and releasably secured in a plurality of relatively angularly adjusted positions for forming different types of cushion furniture.

8 Claims, 8 Drawing Figures

CONVERTIBLE CUSHION FURNITURE

BACKGROUND OF THE INVENTION

Various forms of convertible cushion furniture heretofore has been provided such as the various structures in U.S. Pat. Nos. 3,736,023, 3,742,526, 3,808,616, 3,902,759 and 4,133,045.

However, the convertibility of these previously known forms of cushion furniture and their ability to form different types or shapes of cushion furniture is limited, at least to some degree. Accordingly, a need exists for cushion furniture incorporating a plurality of cushions which may be angularly displaced relative to each other in order to form a plurality of different shapes of furniture.

BRIEF DESCRIPTION OF THE INVENTION

The convertible cushion furniture of the instant invention incorporates four end to end parallelopiped cushions with adjacent cushions connected together for relative angular displacement about axes extending transversely of the cushions. When the four cushions are arranged to end-to-end relations upon a plane surface the points of connection between adjacent cushions either opposes the plane surface or face away from the plane surface. One end cushion is approximately half as long as the other three cushions and has opposite side flaps secured to and extending along its side marginal edges. Opposite side flaps are also secured to and extend along the cushion immediately adjacent the other end cushion and adjustable length straps are releasably connected between corresponding flaps of the end and end adjacent cushions.

The main object of this invention is to provide a convertible cushion structure embodying four cushions connected together for relative angular displacement and which may be arranged in several predetermined positions relative to each other in order to form different types of cushion furniture.

Another object of this invention is to provide a cushion furniture construction in accordance with the preceding object and including adjustable length strap structures which may be utilized to facilitate retaining the plurality of cushions in predetermined positions relative to each other.

Yet another object of this invention is to provide convertible cushion furniture which is filed with a filler that enables the individual cushions to conform to the shape of a load positioned thereon.

A final object of this invention to be specifically enumerated herein is to provide convertible cushion furniture in accordance with the preceding objects and which will conform to conventional forms of manufacture, be of simple construction and easy to use so as to provide a device that will be economically feasible, long lasting and relatively trouble free is operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
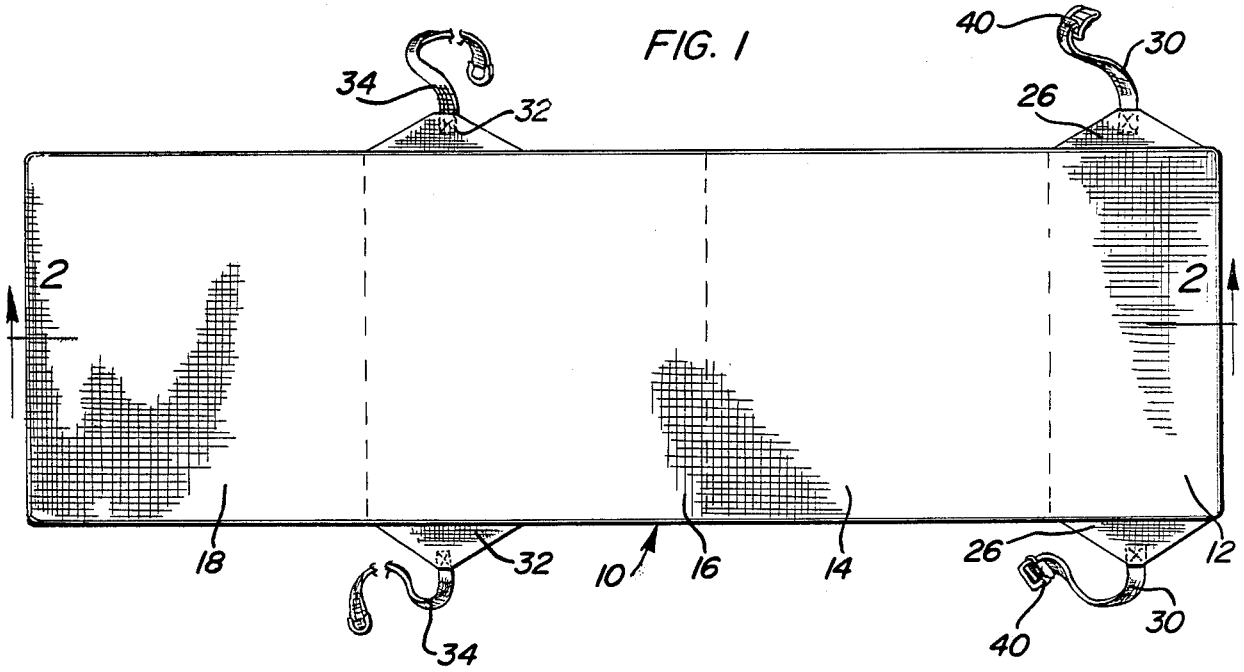
FIG. 1 is a top plan view of the convertible cushion furniture of the instant invention with the four cushion portions thereof arranged in end to end aligned relation.

Referring now more specifically to the drawings the numeral 10 generally designates the convertible cushion furniture assembly of the instant invention. The assembly 10 includes first, second, third and fourth cushions 12, 14, 16 and 18. The cushions 12, 14, 16 and 18 are substantially parallelopiped in shape and each includes a six sided flexible housing filled with loose styrofoam fill 19 the size and shape of baby marshmallows. The cushions may be arranged is end-to-end relation as shown in FIGS. 1, 2 and 3 with the length of each of the cushions 14, 16 and 18 being approximately 24 inches, the length of the cushion 12 being approximately 12 inches and the width and height of each of the cushions being approximately 26 and 7 inches, respectively.

Figure 2:
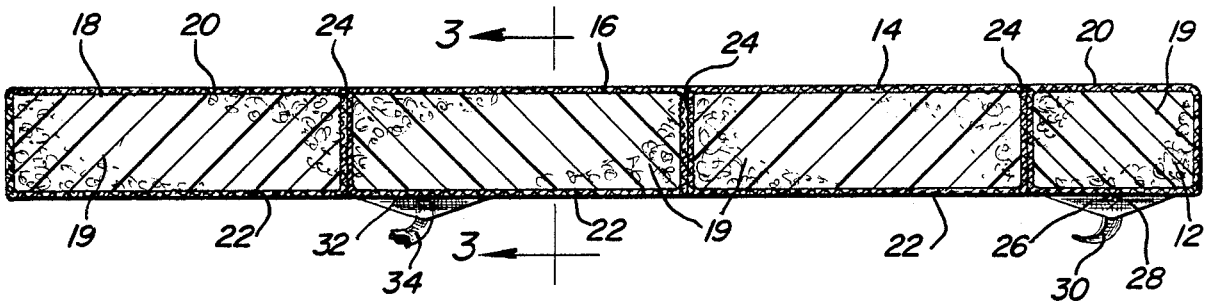
FIG. 2 is a vertical sectional view taken substantially upon the plane indicated by the section line 2—2 of FIG. 1.
Figure 3:
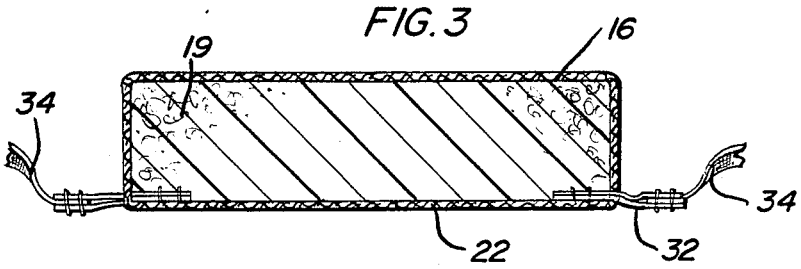
FIG. 3 is a transverse vertical sectional view on somewhat of an enlarged scale taken substantially upon the plane indicated by the section line 3—3 of FIG. 2.

The cushions, when positioned in end-to-end relation as though lying upon a plane surface, include corresponding remote face surfaces 20 and 22 which face upwardly and downwardly, respectively, as illustrated in FIGS. 1, 2 and 3. However, the entire assembly 10 may of course be inverted whereby the face surfaces 20 and 22 face downwardly and upwardly, respectively.

The adjacent ends of the face surfaces 20 are hinged together as at 24 whereby adjacent cushions may be relatively angulated, see FIGS. 4, 5, 6 and 7. Adjacent cushions may be relatively angulated 180° from the positions thereof illustrated in FIGS. 1 and 2 and the lower longitudinal edges of the cushion 12 include superposed pairs of triangular anchor flaps 26 secured thereto and extending therealong with the base marginal edge portions of the flaps 26 secured to the longitudinal edges of the cushion 12 and the heighth apex portions 28 of the flaps 26 including corresponding buckle equipped anchor straps 30 secured therebetween. The lower longitudinal edges of the cushion 16 include similar superposed pairs of triangular flaps 32 secured thereto at the ends thereof adjacent the cushion 18 and the flaps 32 include flexible anchor straps 34 secured between the outer heighth apex portions thereof.

When the cushions 12, 14, 16 and 18 are arranged as illustrated in FIGS. 1 and 2 of the drawings the entire assembly defines a plain mat-type structure.

Figure 4:
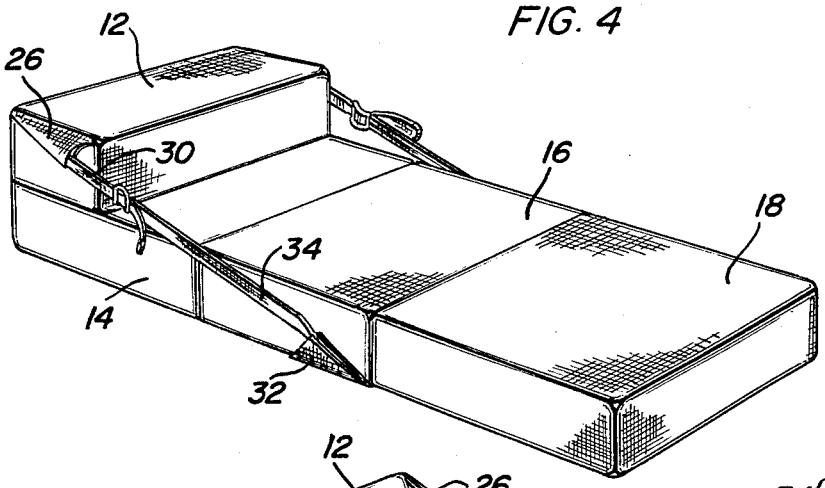
FIGS. 4, 5, 6 and 7 are perspective views of selected different forms of furniture which may be formed utilizing the convertible cushion furniture of the instant invention.

When the cushion 12 is angularly displaced 180° relative to the adjacent cushion 14 and the anchor straps 30 and 34 are secured together in long strap forming positions such as that illustrated in FIG. 4, the resultant structure comprises a reclining mat including a headrest defined by the cushion 12. On the other hand, the straps 30 and 34 may be shortened in order to maintain the cushion 14 angularly displaced approximately 60° relative to the cushion 16 in order to form a backrest in the manner illustrated in FIG. 5 of the drawings and with the cushion 12 forming a headrest at the upper end of the backrest. Further, with the strap members 30 and 34 slightly lengthened in the manner illustrated in FIG. 6 of the drawings, the cushion 14 may be supported in position inclined approximately 80° relative to the cushion 16 and with the cushion 12 forming an upward extension of the upper end of the inclined cushion 14. Still further, the anchor straps 30 and 34 may be secured in the positions illustrated in FIG. 7 wherein the cushion 14 forms a base for the seat cushion 12 and the two cushions 16 and 18 forming a backrest.

It is deemed evident that various other positions of the cushions 12, 14, 16 and 18 may be used in order to form still further shapes of furniture.

Figure 8:
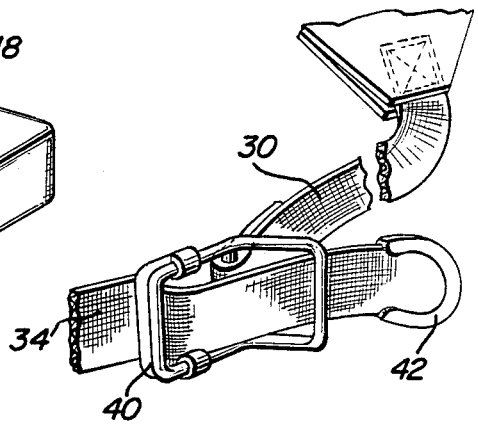
FIG. 8 is a fragmentary perspective view illustrating the manner in which the adjustable length strap members may be secured together between corresponding side flaps of a pair of individual cusions of the cushion furniture.
Figure 5:
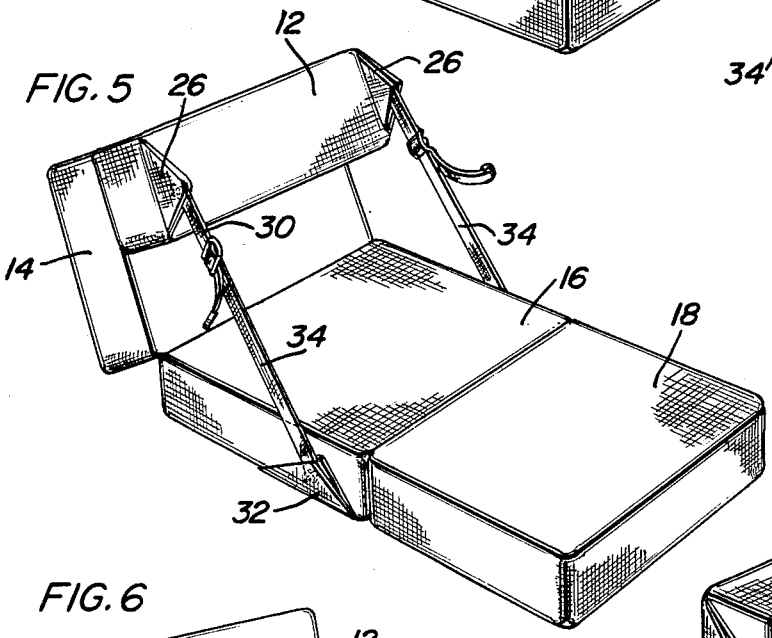
Figure 7:
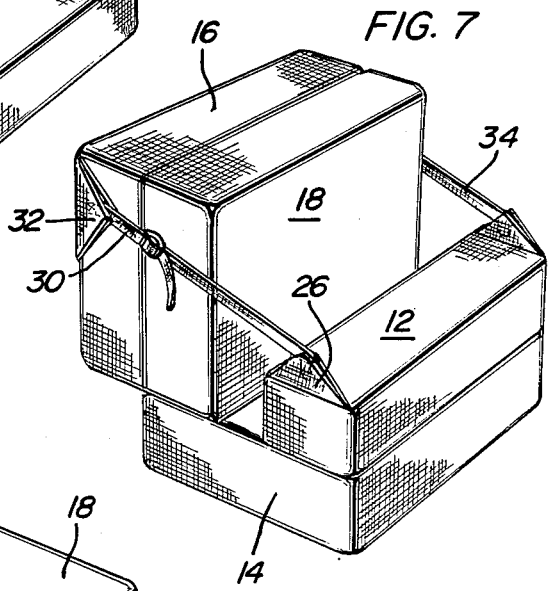
Figure 6:
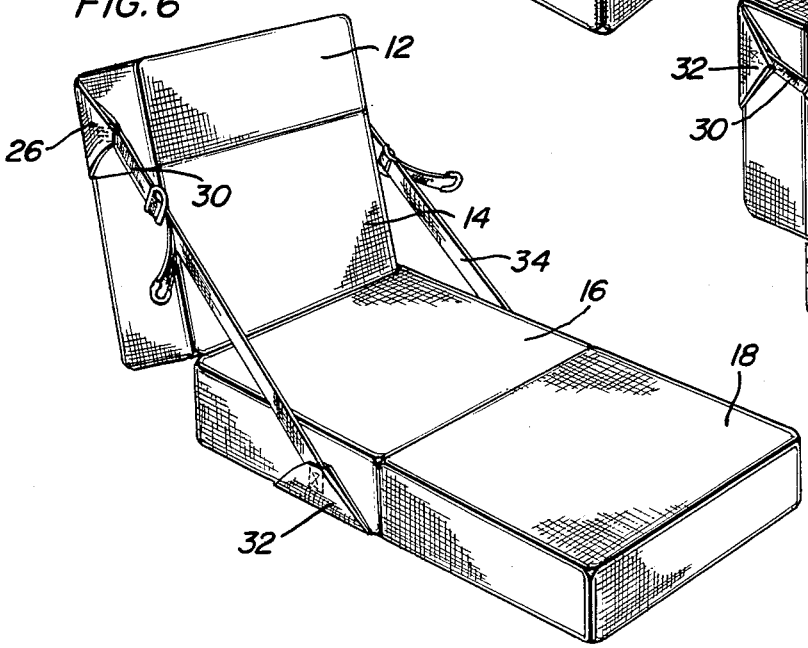

With attention now invited more specifically to FIG. 8, it may be seen that the anchor straps 30 are equipped with buckles 40 and that the anchor straps 34 have end members 42 secured to the free ends thereof. The anchor straps 30 and 34 may be of any suitable construction such as woven nylon.

Although the fill 19 has been described as loose styrofoam fill, it is deemed apparent that other fill materials and sizes of loose fill material may be used. The cushions 12, 14, 16 and 18 are not damaged by water and the loose styrofoam fill 19 therein renders the cushions extremely buoyant. Accordingly, the furniture assembly may be used either in or out of the water with the cushions arranged in any of the various positions thereof illustrated in FIGS. 2, 4, 5 and 6.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A convertible cushion furniture assembly, said assembly including four generally rectangular cavity defining flexible housings each including six interconnected panel portions, said housings each being filled with a loose lightweight filler material to form a generally rectangular parallelopiped cushion which is shape retentive, but somewhat deformable and capable of conforming, at least to some degree, to a body part engaged therewith, said cushions being disposed in end-to-end relation and positionable on a plane surface with either first or second corresponding face surfaces of said cushions opposing said plane surface, each pair of adjacent cushion ends being connected together for relative angular displacement about a transverse axis with the axes of relative angular displacement of adjacent cushions extending along corresponding end transverse marginal portions of said first corresponding face surfaces of said cushions, said cushions being generally the same transverse width and height, three adjacent cushions of said four cushions being generally the same length with the fourth cushion comprising one end cushion being generally one half the length of each of the other three cushions, the longitudinal edges of the first face surface of said one end cushion including first anchor flaps extending therealong and secured thereto for angular displacement relative to said one end cushion about axes extending along said longitudinal edges, the longitudinal edges of the first face surface of a second cushion immediately adjacent the other end cushion including second anchor flaps extending therealong and secured thereto for angular displacement relative to the second cushion about axes extending along the last-mentioned longitudinal edges, and adjustable length flexible elongated tension member means releasably connected between pairs of corresponding first and second flaps.

2. The furniture assembly of claim 1 wherein said flaps are generally triangular in shape with their base edges extending along the corresponding longitudinal edges and said tension member means connected to the height apex portions of said flaps.

3. The furniture assembly of claim 1 wherein said three cushions are generally 24 inches in length and generally 7 inches thick.

4. The furniture assembly of claim 1 wherein said cushions are generally 26 inches in width.

5. The furniture assembly of claim 4 wherein said three cushions are generally 24 inches in length and generally 7 inches thick.

6. The furniture assembly of claim 5 wherein said flaps are generally triangular in shape with their base edges extending along the corresponding longitudinal edges and said tension member means connected to the height apex portions of said flaps.

7. The furniture assembly of claim 1 wherein said loose light-weight filler material comprises loose styrofoam the size and general shape of baby marshmallows.

8. The furniture assembly of claim 1 wherein said adjustable length flexible elongated tension member means comprise strap members anchored to each of said flaps, the strap members anchored relative to said first anchor flaps including buckles thereon.

* * * * *